US007353729B2

(12) United States Patent
Willemsen et al.

(10) Patent No.: US 7,353,729 B2
(45) Date of Patent: Apr. 8, 2008

(54) ADJUSTABLE CONTROL VEHICLE PEDAL

(75) Inventors: Larry G. Willemsen, Morpeth (CA); Chong W. Shon, Ontario (CA); David Jeong, Ontario (CA)

(73) Assignee: KSR Technologies Co., Ridgetown, Ontario ( * ) Notice: Subject to any disclaimer, the term of this patent is extended or adjusted under 35 U.S.C. 154(b) by 656 days.

(21) Appl. No.: 10/488,318

(22) PCT Filed: Aug. 31, 2001

(86) PCT No.: PCT/US01/41979

§ 371 (c)(1),
(2), (4) Date: Jun. 18, 2004

(87) PCT Pub. No.: WO03/023543

PCT Pub. Date: Mar. 20, 2003

(65) Prior Publication Data

US 2004/0217726 A1 Nov. 4, 2004

Related U.S. Application Data

(63) Continuation-in-part of application No. 09/614,101, filed on Jul. 12, 2000, now Pat. No. 6,389,927.

(51) Int. Cl.
*G05G 1/14* (2006.01)

(52) U.S. Cl. ..... 74/512

(58) Field of Classification Search ..... 74/512, 74/513, 560

See application file for complete search history.

(56) References Cited

U.S. PATENT DOCUMENTS 2,860,780 A 11/1958 Huff et al.
3,151,499 A * 10/1964 Roe ..... 74/560
3,691,868 A 9/1972 Smith ..... 74/512
3,828,625 A * 8/1974 Bruhn, Jr. ..... 74/512
4,470,570 A 9/1984 Sakurai et al.
5,010,782 A 4/1991 Asano et al.
5,056,742 A 10/1991 Sakurai
5,086,663 A 2/1992 Asano et al.
5,121,889 A 6/1992 Carey, Jr.
5,125,483 A 6/1992 Kitagawa et al.
5,211,072 A 5/1993 Barlas et al. ..... 74/512
5,460,061 A 10/1995 Redding et al. ..... 74/512
5,819,593 A 10/1998 Rixon et al. ..... 74/512
5,884,532 A 3/1999 Rixon et al. ..... 74/512

(Continued)

*Primary Examiner*—Vicky A. Johnson
(74) *Attorney, Agent, or Firm*—Gifford, Krass, Sprinkle, Anderson & Citkowski, P.C.

(57) ABSTRACT

An adjustable control pedal assembly (10) for a vehicle includes a bracket (12) adapted for mounting on the vehicle, an adjustment member (30) pivotally attached to the bracket (12), and a control mechanism (14) mounted to the adjustment member (30), for pivotal movement of the adjustment member (30) about a first axis (34) generally horizontal and transverse to the vehicle, and a pedal arm (16) attached to the control mechanism (14) for pivotal movement relative thereto about a second axis (52) parallel to the first axis (34). The control mechanism (14) includes an electronic control means (66) responsive to the degree of relative movement of the adjustment member (30) and the pedal arm (16) to produce a control signal proportional to such movement, and a motor (18) mounted on the bracket (12) adjacent the control mechanism (14), and a drive means (20) connecting the motor (18) to the control mechanism (14) for moving the control mechanism (14) and pedal arm (16) as a unit.

11 Claims, 4 Drawing Sheets

U.S. PATENT DOCUMENTS

| | | | | |
|---|---|---|---|---|
| 5,927,154 | A | 7/1999 | Elton et al. | |
| 5,937,707 | A | 8/1999 | Rixon et al. | 74/560 |
| 5,996,438 | A | 12/1999 | Elton | 74/512 |
| 6,019,015 | A | 2/2000 | Elton | 74/513 |
| 6,073,515 | A | 6/2000 | Elton et al. | |
| 6,151,985 | A | 11/2000 | Garber et al. | |
| 6,237,565 | B1 | 5/2001 | Engelgau | |
| 6,389,927 | B1 * | 5/2002 | Willemsen | 74/514 |
| 6,520,045 | B2 * | 2/2003 | Fukase et al. | 74/512 |
| 7,146,876 | B2 * | 12/2006 | Willemsen et al. | 74/512 |

* cited by examiner

ADJUSTABLE CONTROL VEHICLE PEDAL

REFERENCE TO RELATED APPLICATIONS

This application is a U.S. National Phase application from PCT patent application Ser. No. PCT/US01/41979 filed Aug. 31, 2001 and entitled "Adjustable Control Vehicle Pedal-"which in turn is a continuation-in-part of U.S. patent application Ser. No. 09/614,101 filed on Jul. 12, 2000 now U.S. Pat. No. 6,389,927.

FIELD OF INVENTION

This invention relates to control pedals, more particularly to the powered adjustment of the position of such pedals.

BACKGROUND OF THE INVENTION

A variety of adjustable control pedal arrangements have been provided to complement other adjustments to other mechanisms such as adjustable steering wheels and seats to accommodate drivers of different sizes.

Adjustable pedal systems typically have attempted to utilize existing mounting brackets and the like and require the separate installation of the various components such as pedals, electronic controls and the motor for powering the arrangement with the accompanying need to tailor each of the various components to the available mounting arrangements in a specified vehicle.

It is an object of the invention to provide an adjustable pedal control assembly for vehicles which can be fabricated as a complete assembly to include the control mechanism, control pedal and the motor for adjusting the mechanism as a complete assembly to eliminate the need of customizing the various parts in an effort to utilize existing mounting structures.

It is another object of the invention to provide an adjustable pedal assembly which can be installed as a unit in original equipment or in the after market, without the need for elaborate redesign of mounting structures or components.

It is a further object of the invention to provide an adjustable pedal assembly which includes the motor positioned adjacent the control mechanism, to improve vehicle packaging considerations.

SUMMARY OF THE INVENTION

These and other objects of the invention are accomplished by a mounting bracket which acts as a base member to support the remaining components of the total control assembly such as the motor, control mechanism, the pedal arm and drive mechanism. The complete assembly includes a bracket adapted for mounting on the wall of a vehicle adjacent to the driver's position, an adjustment member pivotally mounted to the bracket, a control mechanism mounted to the adjustment bracket, and a pedal pivotally mounted to the control mechanism. The control mechanism includes an electronic control means responsive to the degree of relative movement of the adjustment member and the pedal to produce a control signal proportional to the pivotal movement, together with a motor mounted directly on the bracket and adjacent the control member with a drive means connecting the motor to the control member for pivoting the adjustment member together with the pedal arm to selected positions by the driver.

BRIEF DESCRIPTION OF THE DRAWINGS

Other objects, features and advantages of the present invention will become apparent by reference to the following description and to the drawings in which.

DETAILED DESCRIPTION OF THE DRAWINGS

Figure 1:
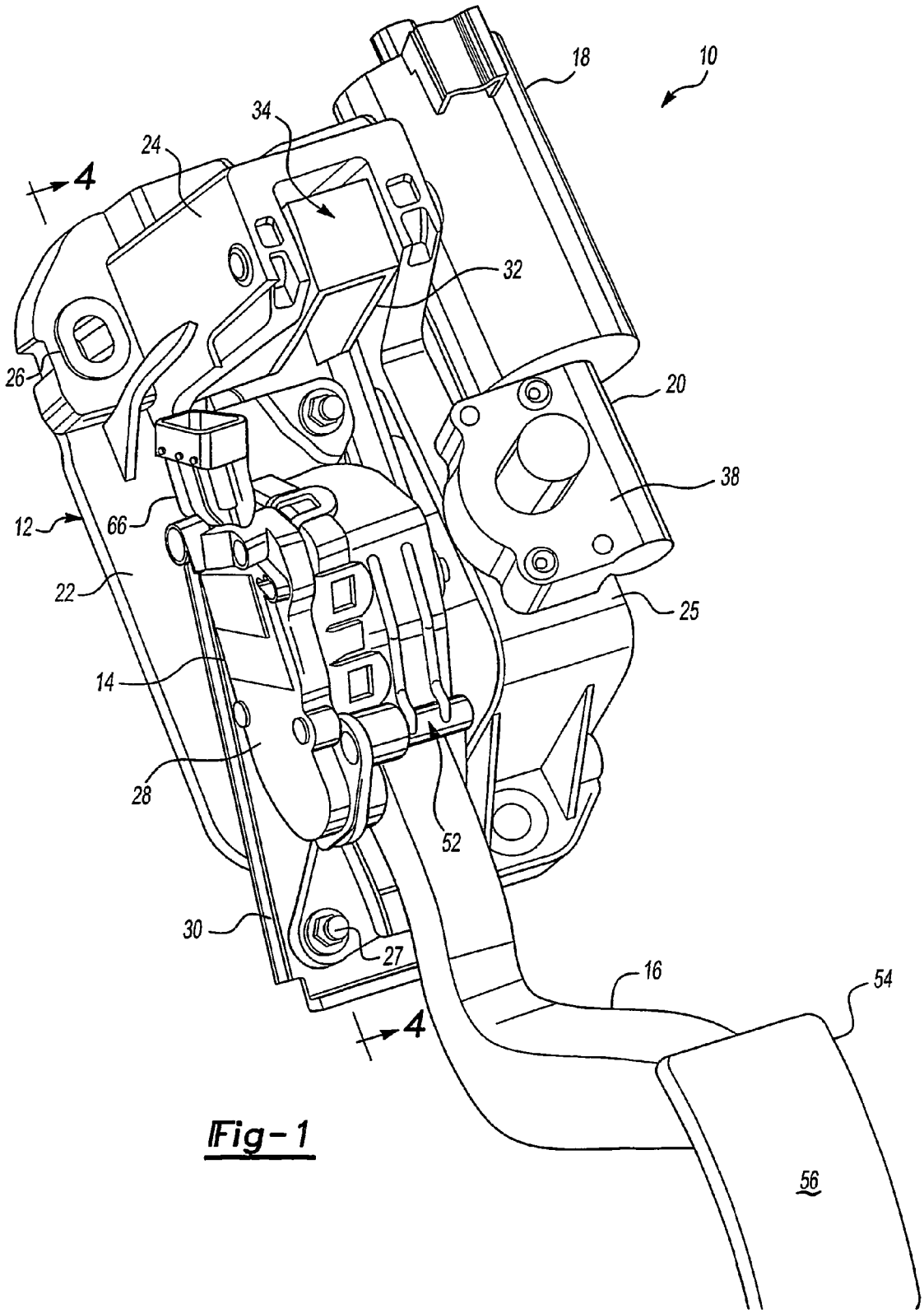
FIG. 1 is a perspective view of the adjustable control pedal assembly embodying the invention.

Referring to FIGS. 1-4, an adjustable control pedal assembly 10 for a vehicle (not shown) embodying the invention is illustrated. The adjustable control pedal assembly 10 includes a bracket member 12 which supports a control mechanism 14, a pedal arm 16, a motor 18, and drive means 20 connecting the motor 18 to the control mechanism 14 for powered movement of the latter. The bracket member 12 is intended for mounting of the adjustable control pedal assembly 10 in the passenger compartment of the vehicle, preferably on the fire wall immediately ahead of a driver's position. The bracket member 12 includes a generally planar support surface 22 for attachment to the firewall, and a support arm 24 extending generally perpendicular to an upper portion of the support surface 22, to pivotally support an adjustment member 30. It should be appreciated that the support arm 24 has a U-shape and is generally parallel to the longitudinal axis of the vehicle. The bracket member 12 further includes a raised portion 25 adjacent the support arm 24 that provides a support surface for a motor 18 and a drive means 20. Preferably, the bracket member 12 is provided with a mounting boss as shown at 26 to receive a bolt (not shown) by which the entire assembly 10 can be fastened to the wall of the vehicle.

The adjustable pedal control assembly 10 includes a motor 18 which is known and conventional in the art, for actuating the control mechanism 14. The motor 18 is attached to the bracket member 12 in a fixed position by a conventional fastening means (not shown). Preferably, the motor 18 is positioned on the raised portion 25 of the bracket 12 adjacent the support arm 24, and is disposed with its axis of rotation substantially vertical and parallel to the support surface 22 of the bracket 12.

Figure 3:
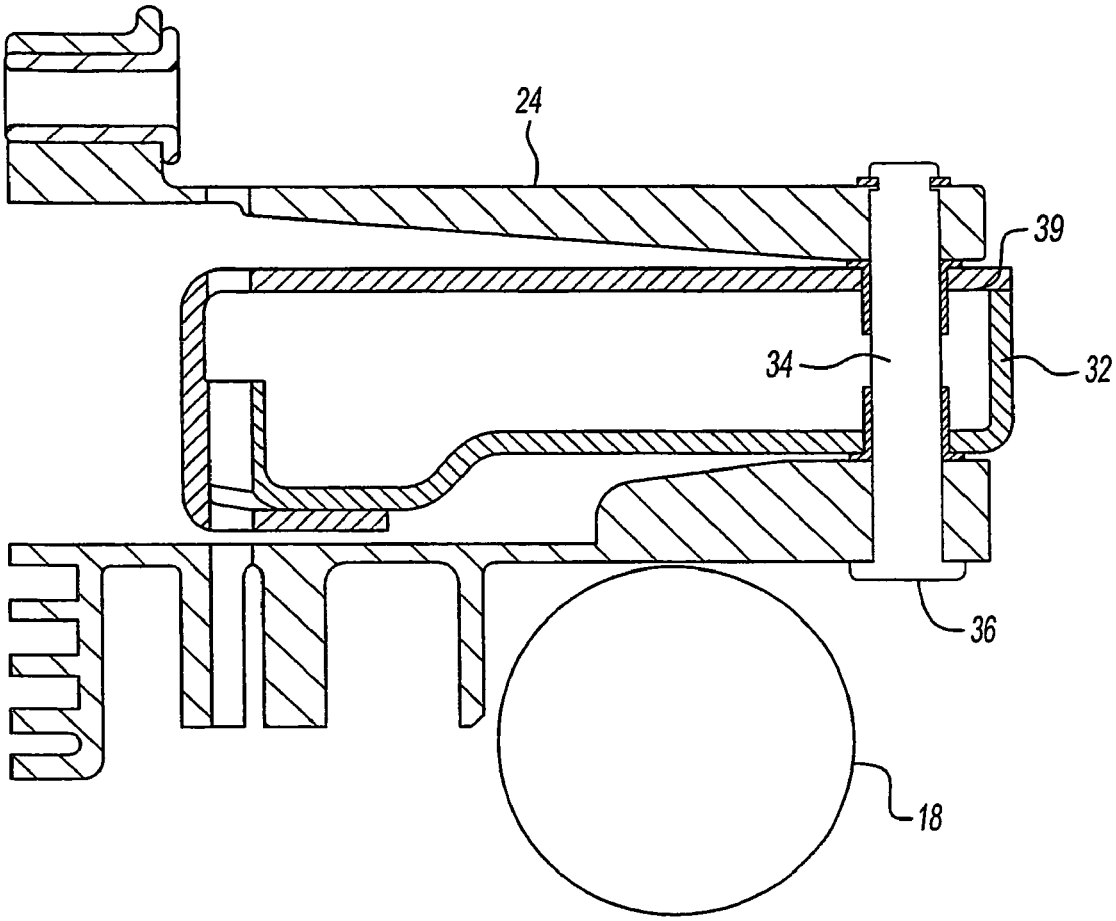
FIG. 3 is a sectional view taken along line 3-3 of FIG. 2 of a support arm for the pedal assembly according to the present invention.

The control mechanism 14 provides for adjustment of the adjustable control pedal assembly 10 and includes a housing 28 mounted to the adjustment member 30. It should be appreciated that the control mechanism 14 further includes a signal means, shown at 66, that is responsive to the movement of the control mechanism 14 and pedal arm 16 to produce an electrical signal proportional to the degree of movement of the control mechanism 14 and pedal arm 16. The adjustment member 30 is a generally planar member and includes an arm 32 extending perpendicular to an upper end of the adjustment member 30. A free end of the arm 32 is pivotally attached to the support arm 24 at an upper pivot point, as shown at 34. As shown in FIG. 3, a pivot pin 36 extends therethrough an opening in the arm 32 to pivotally retain the arm 32 in the support arm 24, to form a generally horizontal pivot axis 34 extending transversely to the direction of movement of the vehicle. Advantageously, the adjustment member 30 is suspended from the support arm 24 of the bracket 12. In this example, a bushing 39 is disposed around the pivot pin 36 to facilitate the pivotal movement of the adjustment member 30 relative to the pivot axis 34.

Figure 4:
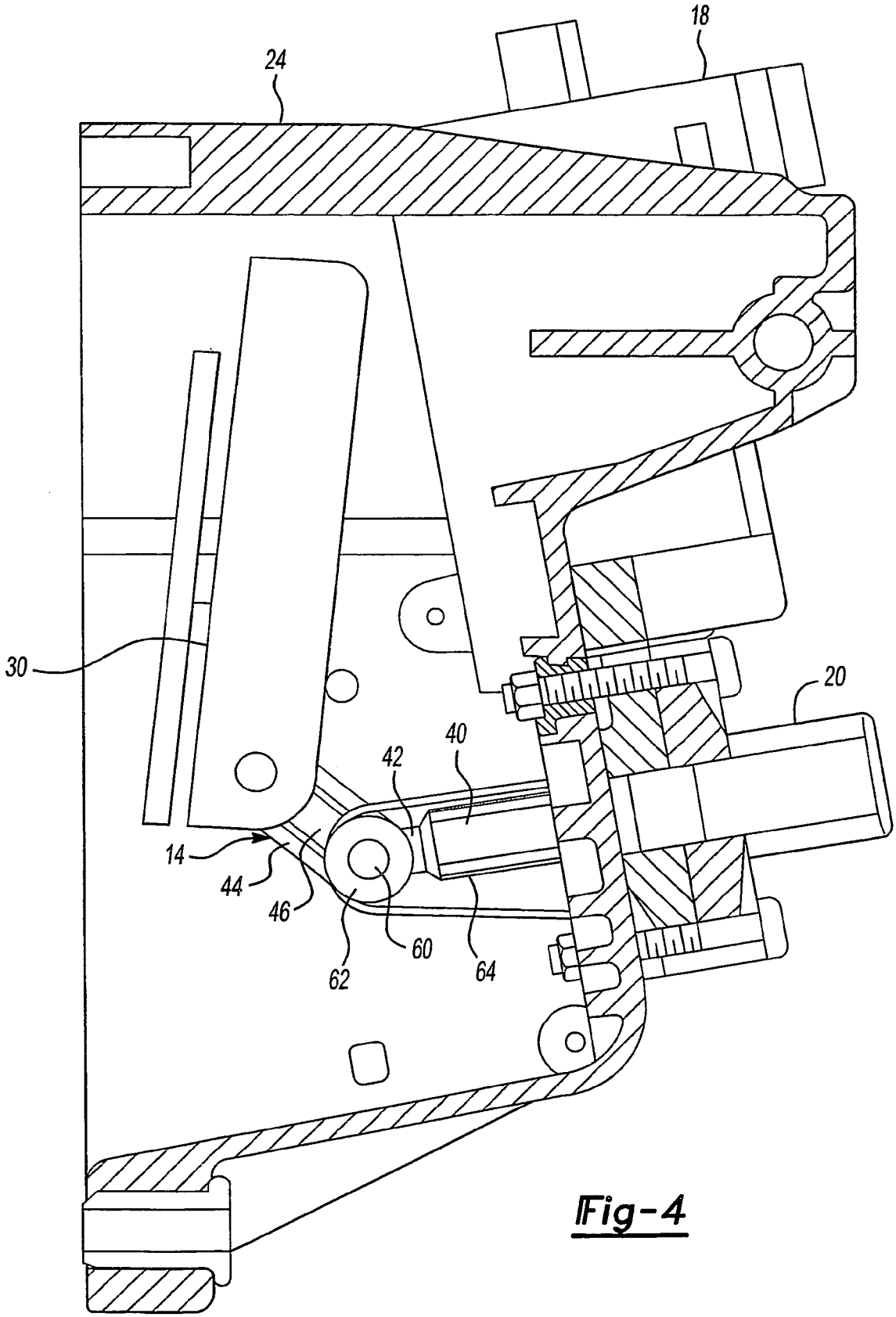
FIG. 4 is a sectional view taken along line 4-4 of FIG. 1 of a control mechanism for the pedal assembly according to the present invention.

As shown in FIG. 4, the motor 18 is connected to the control mechanism 14 by the drive means 20 to provide motion to pivot the adjustment member 30 with the control mechanism 14 mounted thereto, relative to its pivot axis 34. For example, the drive means 20 includes a housing 38 containing a threaded drive screw 40, which extends at right angles to a main drive shaft (not shown) of the motor 18. The main drive shaft includes a worm gear which engages the threaded drive screw 40. An end 42 of the threaded drive screw 40 is operatively connected to the control mechanism 14 by a complementary threaded member 64. The complementary threaded member 64 is slidably supported by a link 44. The link 44 is a generally planar member having a slot 46. For example, the complementary threaded member 64 is connected to the link 44 by a pin 60 and push nut 62 slidingly disposed in the slot 46 of the link 44, as is understood in the art. The link 44 is rotatably attached to an end of the adjustment member 30, such as by another pin 60 and push nut 62. Actuation of the motor 18 and rotation of the drive shaft 40 causes the adjustment member 30 to be pivoted about the pivot axis 34. During such movement, the arcuate movement of the adjustment member 30 is accommodated by movement of the link 44.

The pedal arm 16 is pivotally connected to the control member 14 for relative movement about a pivot axis indicated generally at 52 and extending parallel to and below pivot axis 34. Movement of the pedal arm 16 relative to the control mechanism 14 is effective to produce an electronic control signal proportional to the position of the control mechanism 14 and pedal arm 16 for the operation of brakes, transmissions or engine controls, such as controls commercially available from Hella of Germany.

A pedal pad support 54 is mounted to an end of pedal arm 16. In this example, the pedal pad support 54 has a curved, convex upper surface as shown at 56. When the pedal arm 16 is in a fully forward position, the forward portion of the pedal pad 54 is in position for depression by the driver. When the pedal pad 54 is adjusted toward the rear of the vehicle, the pedal pad 54 moves along an arc and the rear portion of the convex surface 56 is in a position for engagement by the foot of the driver. In this example, the pedal pad support 54 is cast as an integral portion of the pedal arm 16. Alternatively, an elastomeric pedal pad (not shown), as is known in the art, can be mounted to the pedal arm 16.

It should be appreciated that the adjustable pedal assembly 10 may include other component parts, such as switches (not shown) or the like, which are known and conventional in the art for the adjustable control pedal assembly 10. Advantageously, the adjustable control pedal assembly 10 may be supplied in its assembled condition for installation as a unit in the vehicle. The position of the motor 18 adjacent to the control mechanism 14 improves the packagability of the adjustable pedal assembly relative to other parts of the vehicle, such as ducts or a tunnel. In addition, the use of the pedal adjustment member 30 facilitates commonization of adjustable pedal assemblies between various vehicle types. After mechanical connections are made to support the assembly 10 in the vehicle, various electrical connections can be made between the control mechanism 14 and the mechanisms to be operated, such as brakes, transmission and throttles.

Figure 2:
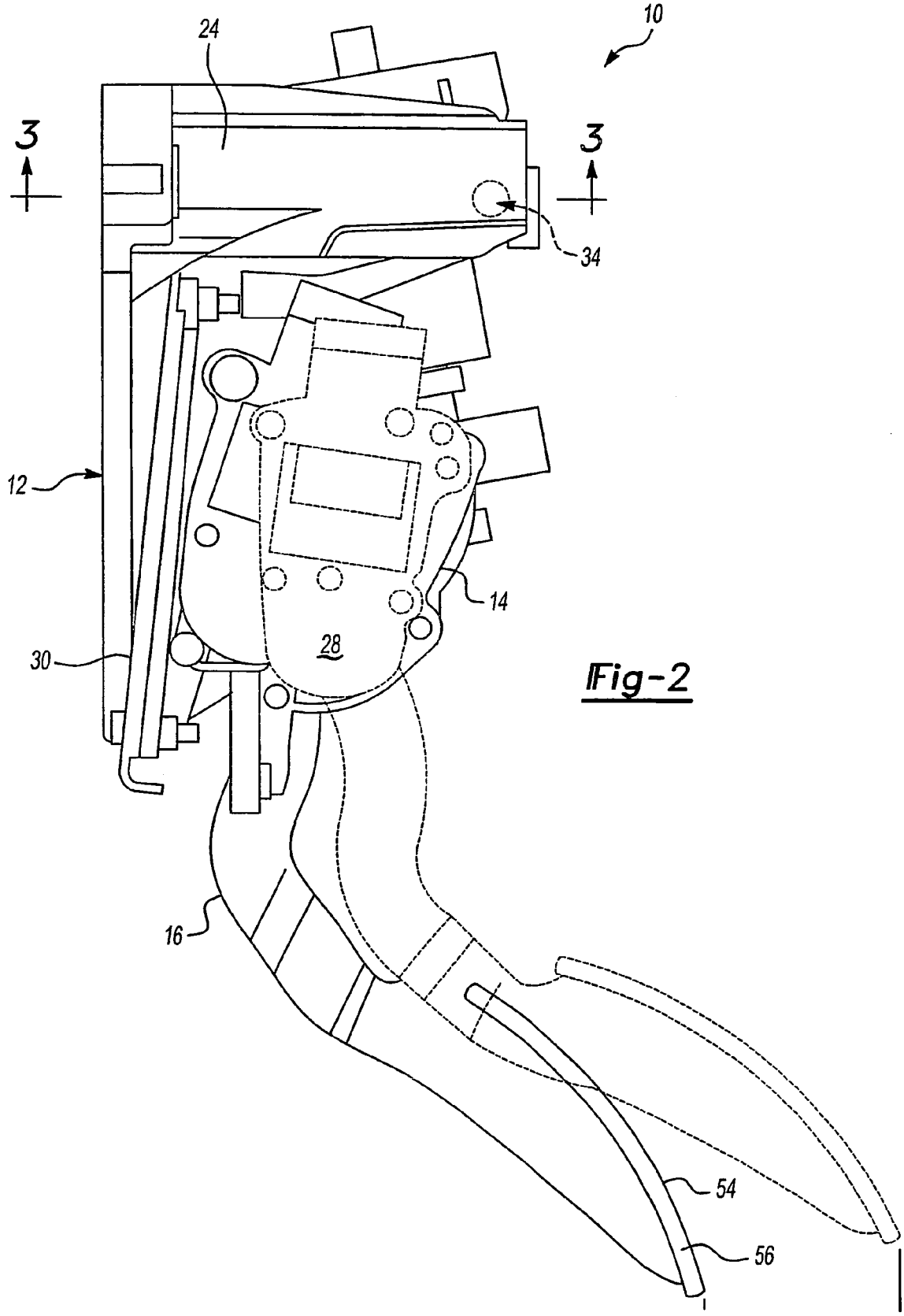
FIG. 2 is a diagrammatic side view of the pedal assembly of FIG. 1 showing the range of operation according to the present invention.

In operation, a control such as a switch (not shown) is activated to energize the motor 18, which causes pivoting of the adjustment member 30 and pedal arm 16 attached thereto, to selected positions relative to the bracket 12 and therefore the vehicle itself, as best seen in FIG. 2. Advantageously, the distance of the pedal pad relative to the driver can be modified to accommodate a wide variety of driver sizes. Such actuation of the motor 18 causes the control mechanism 14 and pedal arm 16 to move as a unit between the extreme positions indicated in full line and in broken line in FIG. 2, with the extent of adjustment indicated by the arrow 58.

For example, the pedal pad 56 can be positioned along an arcuate path of 75 mm. During such movement, the link translates the rotary motion of the drive screw 40 into the linear motion of the adjustment member 30, by movement of the drive screw 40 in the slot 46 of the link 44, to permit arcuate pivotal movement of the adjustment member 30 with control mechanism 14 mounted thereto, together with the pedal arm 16, about the pivot axis 34. Subsequent movement of the pedal arm 16 relative to the stationary control mechanism 14 produces an electronic signal for operating various mechanisms of the vehicle and such a signal is in direct proportion to the relative positions of the control mechanism 14 and pedal arm 16 during the full range of movement of the control mechanism 14.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

The invention claimed is:

1. An adjustable control pedal assembly for a vehicle comprising:

a bracket adapted for mounting on the vehicle;

an adjustment member pivotally attached to said bracket;

a control mechanism mounted to said adjustment member, for pivotal movement of said adjustment member about a first axis generally horizontal and transverse to the vehicle;

a pedal operatively attached to said control mechanism for pivotal movement relative thereto about a second axis parallel to said first axis;

wherein said control mechanism includes an electronic control means responsive to the degree of relative movement of said adjustment member and said pedal to produce a control signal proportional to such movement; and a motor mounted on said bracket adjacent said control mechanism, and a drive means connecting said motor to said control mechanism for moving said adjustment member, control mechanism and pedal as a unit.

2. The pedal assembly of claim 1 wherein said drive means connecting said motor and said control mechanism includes a threaded drive screw operatively connected to said control member by a complementary threaded member.

3. The pedal assembly of claim 2 wherein said control mechanism includes a link having a slot, and said complementary threaded member is slidably supported within the slot.

4. The pedal assembly of claim 1 wherein the bracket includes a generally planar support surface, a support arm extending from the support surface, and a raised portion adjacent the support arm for mounting said motor thereto.

5. An adjustable control pedal assembly for adjusting the position of a pedal relative to the operator of a vehicle comprising:

a bracket adapted to be supported on the vehicle in a generally vertical position;

an adjustment member having a control mechanism mounted thereto, wherein said adjustment member is pivotally mounted to said bracket and said control mechanism operatively controls the pivotal movement of said adjustment member about a first axis;

a pedal, wherein said pedal includes a pedal arm having a pedal pad mounted thereto, wherein said pedal arm is operatively connected to said control mechanism for pivotal movement about a second axis parallel to said first axis;

wherein said control mechanism includes a signal means that is responsive to the movement of said control mechanism and pedal arm to produce an electrical signal proportional to the degree of movement of said control mechanism and pedal arm; and a motor mounted to said bracket in a position adjacent said control mechanism, wherein said motor is connected to said control mechanism by a drive means for movement of said control member and pedal as a unit to selected angular positions relative to said bracket.

6. The pedal assembly of claim 5 wherein said drive means connecting said motor and said control mechanism includes a threaded drive screw operatively connected to said control member by a complementary threaded member.

7. The pedal assembly of claim 6 wherein said control mechanism includes a link having a slot, and said complementary threaded member is slidably supported within the slot.

8. The pedal assembly of claim 6 wherein the bracket includes a generally planar support surface, a support arm extending from the support surface, and a raised portion adjacent the support arm for mounting said motor thereto.

9. An adjustable pedal control assembly for a motor vehicle comprising:

a bracket adapted to be supported in a motor vehicle, wherein said bracket includes a generally planar support surface, a support arm extending perpendicular to the support surface and a raised portion adjacent the support arm;

an adjustment member, wherein said adjustment member includes a generally planar support surface and an arm extending from an upper edge of said support surface, and a free end of said arm is pivotally attached to said support arm of said bracket member at a first pivot axis;

a control mechanism mounted to said adjustment member;

a pedal having a pedal arm operatively connected to said control mechanism for pivotal movement about a second pivot axis, said pedal arm having a pad at one end for engagement by the foot of an operator;

wherein said control mechanism includes an electronic signal means that produces a signal proportional to the movement of said pedal arm relative to said control mechanism and said adjustment member, about said second pivot point, for all angular positions of said pedal;

a motor supported on said bracket, wherein said motor is attached to said raised portion; and a drive means connecting said motor to said control mechanism to pivot the control mechanism, adjustment member and said pedal as a unit about said first pivot point, to position said pedal pad relative to an operator of the vehicle.

10. The pedal assembly of claim 9 wherein said drive means connecting said motor and said control mechanism includes a threaded drive screw operatively connected to said control member by a complementary threaded member.

11. The pedal assembly of claim 10 wherein said control mechanism includes a link having a slot, and said complementary threaded member is slidably supported within the slot.

* * * * *

UNITED STATES PATENT AND TRADEMARK OFFICE

CERTIFICATE OF CORRECTION

PATENT NO. : 7,353,729 B2
APPLICATION NO. : 10/488318
DATED : April 8, 2008
INVENTOR(S) : Larry Willemsen et al.

It is certified that error appears in the above-identified patent and that said Letters Patent is hereby corrected as shown below:

Column 4, claim 1 should read as follows:

1. An adjustable control pedal assembly for a vehicle comprising:

[[a]] one bracket having a support surface adapted for mounting on the vehicle, the bracket having a support arm extending perpendicular to the support surface;

an adjustment member having an uppermost end pivotally ~~attached to~~ suspended from the free end of said bracket support arm at a first fixed axis that is generally horizontal and transverse to the vehicle;

a control mechanism mounted to said adjustment member, for pivotal movement of said adjustment member about [[a]] the first fixed axis ~~generally horizontal and transverse to the vehicle~~;

a pedal operatively attached to said control mechanism for pivotal movement relative thereto about a second axis that is parallel to and positioned below said first axis;

wherein said control mechanism includes an electronic control means responsive to the degree of relative movement of said adjustment member and said pedal to produce a control signal proportional to such movement; and a motor mounted on said bracket support surface in a position adjacent to said control mechanism, and a drive means connecting said motor to said control mechanism for ~~moving~~ pivoting said adjustment member, control mechanism and pedal together as a unit without relative movement between the adjustment member and the pedal, about the first axis when the motor is activated.

Column 4, Claim 4 should read as follows:

4. The pedal assembly of claim 1 wherein the bracket support surface includes a ~~generally planar support surface, a support arm extending from the support surface, and a~~ raised portion ~~adjacent the support arm~~ for mounting said motor thereto.

Column 5, Claim 5 should read as follows:

5. An adjustable control pedal assembly for adjusting the position of a pedal relative to the operator of a vehicle comprising:

[[a]] one bracket having a support surface adapted to be supported on the vehicle in a generally vertical position wherein the bracket includes a support arm extending perpendicular to the support surface;

It is certified that error appears in the above-identified patent and that said Letters Patent is hereby corrected as shown below:

an adjustment member having a control mechanism mounted thereto, wherein said adjustment member ~~is~~ has an uppermost end pivotally mounted to an outermost portion of the free end of said bracket support arm and said control mechanism operatively controls the pivotal movement of said adjustment member about a first fixed axis that is generally horizontal and transverse to the vehicle;

a pedal, wherein said pedal includes a pedal arm having a pedal pad mounted thereto, wherein said pedal arm is operatively connected to said control mechanism for pivotal movement about a second axis that is parallel to and positioned below said first axis;

wherein said control mechanism includes ~~a signal~~ means that is responsive to the movement of said control mechanism and pedal arm about said second axis, and to produce an electrical signal proportional to the degree of movement of said control mechanism and pedal arm about said second axis; and a motor mounted to said bracket in a position adjacent said control mechanism, wherein said motor is connected to said control mechanism by a drive means for movement of said control member and pedal together as a unit without relative movement between the adjustment member and the pedal, about the first axis to selected angular positions relative to said bracket when the motor is activated.

Column 5, Claim 8 should read as follows:

8. The pedal assembly of claim 6 wherein the bracket support surface includes a ~~generally planar support surface, a support arm extending from the support surface, and a~~ raised portion ~~adjacent the support arm~~ for mounting said motor thereto.

Column 5, Claim 9 should read as follows:

9. An adjustable pedal control assembly for a motor vehicle comprising:

[[a]] one bracket adapted to be supported ~~in a~~ on the motor vehicle, wherein said bracket includes a generally planar support surface having a raised portion, and a support arm extending perpendicular to the support surface ~~and a raised portion adjacent the support arm~~;

an adjustment member, wherein said adjustment member includes a generally planar support surface and an arm extending from an upper edge of said support surface, and a free end of said arm is pivotally attached to said ~~support arm of said~~ bracket ~~member~~ support arm at a first fixed pivot axis that is generally horizontal and transverse to the vehicle;

a control mechanism mounted to said adjustment member;

UNITED STATES PATENT AND TRADEMARK OFFICE

CERTIFICATE OF CORRECTION

PATENT NO. : 7,353,729 B2
APPLICATION NO. : 10/488318
DATED : April 8, 2008
INVENTOR(S) : Larry Willemsen et al.

It is certified that error appears in the above-identified patent and that said Letters Patent is hereby corrected as shown below:

a pedal having a pedal arm operatively connected to said control mechanism for pivotal movement about a second pivot axis that is parallel to and positioned below the first pivot axis, said pedal arm having a pad at one end for engagement by the foot of an operator;

wherein said control mechanism includes an electronic signal means that produces a signal proportional to the movement of said pedal arm relative to said control mechanism ~~and said adjustment member~~, about said second ~~pivot~~ point axis, for all angular positions of said pedal;

a motor supported on said raised portion of said bracket support surface~~,~~ ~~wherein said motor is attached to said raised portion~~; and a drive means connecting said motor to said control mechanism, to pivot the control mechanism, adjustment member and ~~said~~ pedal together as a unit about said first pivot ~~point~~ axis without relative movement between the adjustment member and the pedal, when the motor is activated to position said pedal pad relative to an operator of the vehicle.

Signed and Sealed this

Twelfth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,353,729 B2
APPLICATION NO. : 10/488318
DATED : April 8, 2008
INVENTOR(S) : Larry Willemsen et al.

It is certified that error appears in the above-identified patent and that said Letters Patent is hereby corrected as shown below:

Column 4, claim 1, lines 36-55 should read as follows:

1. An adjustable control pedal assembly for a vehicle comprising:

[[a]] one bracket having a support surface adapted for mounting on the vehicle, the bracket having a support arm extending perpendicular to the support surface;

an adjustment member having an uppermost end pivotally ~~attached to~~ suspended from the free end of said bracket support arm at a first fixed axis that is generally horizontal and transverse to the vehicle;

a control mechanism mounted to said adjustment member, for pivotal movement of said adjustment member about [[a]] the first fixed axis ~~generally horizontal and transverse to the vehicle~~;

a pedal operatively attached to said control mechanism for pivotal movement relative thereto about a second axis that is parallel to and positioned below said first axis;

wherein said control mechanism includes an electronic control means responsive to the degree of relative movement of said adjustment member and said pedal to produce a control signal proportional to such movement; and a motor mounted on said bracket support surface in a position adjacent to said control mechanism, and a drive means connecting said motor to said control mechanism for ~~moving~~ pivoting said adjustment member, control mechanism and pedal together as a unit without relative movement between the adjustment member and the pedal, about the first axis when the motor is activated.

Column 4, Claim 4, lines 64-67 should read as follows:

4. The pedal assembly of claim 1 wherein the bracket support surface includes a ~~generally planar support surface, a support arm extending from the support surface, and a~~ raised portion ~~adjacent the support arm~~ for mounting said motor thereto.

Column 5, Claim 5, lines 1-25 should read as follows:

5. An adjustable control pedal assembly for adjusting the position of a pedal relative to the operator of a vehicle comprising:

[[a]] one bracket having a support surface adapted to be supported on the vehicle in a generally vertical position wherein the bracket includes a support arm extending perpendicular to the support surface;

It is certified that error appears in the above-identified patent and that said Letters Patent is hereby corrected as shown below:

an adjustment member having a control mechanism mounted thereto, wherein said adjustment member ~~is~~ has an uppermost end pivotally mounted to an outermost portion of the free end of said bracket support arm and said control mechanism operatively controls the pivotal movement of said adjustment member about a first fixed axis that is generally horizontal and transverse to the vehicle;

a pedal, wherein said pedal includes a pedal arm having a pedal pad mounted thereto, wherein said pedal arm is operatively connected to said control mechanism for pivotal movement about a second axis that is parallel to and positioned below said first axis;

wherein said control mechanism includes ~~a signal~~ means that is responsive to the movement of said control mechanism and pedal arm about said second axis, and to produce an electrical signal proportional to the degree of movement of said control mechanism and pedal arm about said second axis; and a motor mounted to said bracket in a position adjacent said control mechanism, wherein said motor is connected to said control mechanism by a drive means for movement of said control member and pedal together as a unit without relative movement between the adjustment member and the pedal, about the first axis to selected angular positions relative to said bracket when the motor is activated.

Column 5, Claim 8, lines 34-37 should read as follows:

8. The pedal assembly of claim 6 wherein the bracket support surface includes a ~~generally planar support surface, a support arm extending from the support surface, and a~~ raised portion ~~adjacent the support arm~~ for mounting said motor thereto.

Column 5, Claim 9, line 38 thru Column 6, line 29 should read as follows:

9. An adjustable pedal control assembly for a motor vehicle comprising:

[[a]] one bracket adapted to be supported ~~in a~~ on the motor vehicle, wherein said bracket includes a generally planar support surface having a raised portion, and a support arm extending perpendicular to the support surface ~~and a raised portion adjacent the support arm~~;

an adjustment member, wherein said adjustment member includes a generally planar support surface and an arm extending from an upper edge of said support surface, and a free end of said arm is pivotally attached to said ~~support arm of said~~ bracket ~~member~~ support arm at a first fixed pivot axis that is generally horizontal and transverse to the vehicle;

a control mechanism mounted to said adjustment member;

UNITED STATES PATENT AND TRADEMARK OFFICE

CERTIFICATE OF CORRECTION

PATENT NO. : 7,353,729 B2
APPLICATION NO. : 10/488318
DATED : April 8, 2008
INVENTOR(S) : Larry Willemsen et al.

It is certified that error appears in the above-identified patent and that said Letters Patent is hereby corrected as shown below:

a pedal having a pedal arm operatively connected to said control mechanism for pivotal movement about a second pivot axis that is parallel to and positioned below the first pivot axis, said pedal arm having a pad at one end for engagement by the foot of an operator;

wherein said control mechanism includes an electronic signal means that produces a signal proportional to the movement of said pedal arm relative to said control mechanism ~~and said adjustment member~~, about said second ~~pivot~~ point axis, for all angular positions of said pedal;

a motor supported on said raised portion of said bracket support surface~~, wherein said motor is attached to said raised portion~~; and a drive means connecting said motor to said control mechanism, to pivot the control mechanism, adjustment member and ~~said~~ pedal together as a unit about said first pivot ~~point~~ axis without relative movement between the adjustment member and the pedal, when the motor is activated to position said pedal pad relative to an operator of the vehicle.

This certificate supersedes the Certificate of Correction issued August 12, 2008.

Signed and Sealed this

Sixteenth Day of September, 2008

Jon W. Dudas

JON W. DUDAS
*Director of the United States Patent and Trademark Office*